US007227317B2

(12) United States Patent
Samuelsson

(10) Patent No.: US 7,227,317 B2
(45) Date of Patent: Jun. 5, 2007

(54) METHOD AND SYSTEM FOR ENHANCED DIMMING RESOLUTION IN A LIGHT BALLAST THROUGH USE OF MULTIPLE CONTROL FREQUENCIES

(75) Inventor: Ulf R. Samuelsson, Stockholm (SE)

(73) Assignee: Atmel Corporation, San Jose, CA (US)

( * ) Notice: Subject to any disclaimer, the term of this patent is extended or adjusted under 35 U.S.C. 154(b) by 261 days.

(21) Appl. No.: 10/865,644

(22) Filed: Jun. 10, 2004

(65) Prior Publication Data

US 2005/0275355 A1 Dec. 15, 2005

(51) Int. Cl.
*H05B 37/02* (2006.01)

(52) U.S. Cl. ..... 315/360; 315/DIG. 4; 315/291

(58) Field of Classification Search ..... 315/307, 315/360, 291, DIG. 4
See application file for complete search history.

(56) References Cited

U.S. PATENT DOCUMENTS

| | | | | | |
|---|---|---|---|---|---|
| 3,763,394 | A * | 10/1973 | Blanchard | 315/294 |
| 5,519,289 | A | 5/1996 | Katyl et al. | 315/224 |
| 5,559,395 | A | 9/1996 | Venkitasubrahmanian et al. | 315/247 |
| 5,589,741 | A * | 12/1996 | Terman et al. | 315/360 |
| 5,604,411 | A | 2/1997 | Venkitasubrahmanian et al. | 315/307 |
| 5,650,694 | A | 7/1997 | Jayaraman et al. | 315/225 |
| 5,691,605 | A | 11/1997 | Xia et al. | 315/307 |
| 5,751,115 | A | 5/1998 | Jayaraman et al. | 315/225 |
| 5,828,187 | A * | 10/1998 | Fischer | 315/291 |
| 5,872,429 | A | 2/1999 | Xia et al. | 315/194 |
| 6,051,938 | A | 4/2000 | Arts et al. | 315/291 |
| 6,088,249 | A | 7/2000 | Adamson | 363/97 |
| 6,094,017 | A | 7/2000 | Adamson | 315/307 |
| 6,100,644 | A | 8/2000 | Titus | 315/209 R |
| 6,181,066 | B1 | 1/2001 | Adamson | 315/282 |
| 6,229,432 | B1 | 5/2001 | Fridley et al. | 340/310.01 |
| 6,307,332 | B1 * | 10/2001 | Noguchi et al. | 315/362 |
| 6,339,298 | B1 | 1/2002 | Chen | 315/224 |
| 6,448,713 | B1 * | 9/2002 | Farkas et al. | 315/291 |
| 6,486,616 | B1 | 11/2002 | Liu et al. | 315/291 |
| 6,710,993 | B1 * | 3/2004 | Wang | 361/93.1 |
| 2002/0195966 | A1 * | 12/2002 | Aoki et al. | 315/169.3 |

* cited by examiner

*Primary Examiner*—Hoanganh Le
*Assistant Examiner*—Tung Le
(74) *Attorney, Agent, or Firm*—Sawyer Law Group LLP

(57) ABSTRACT

A microcontroller or state machine controls a light ballast utilizing a timer structure. The microcontroller can program the timer structure to generate pulses where the "average" frequency of a series of pulses can be varied with higher resolution than the frequency of a single pulse. This variation can occur without further microcontroller/state machine intervention. The pulses are used to control the on and/or off time of the light. The timer can be configured to modulate the outputs fast enough to ensure that the light does not appear to flicker to the human eye by limiting the number of pulses in a frame and by increasing the number of times the frequency shift occurs compared to the obvious implementation. The present invention relies on the fact that the human eye is not capable of detecting small frequency changes in high frequency signals and therefore uses pulses of two or more frequencies where the frequencies are close together. The average frequency can then be varied at much higher resolution than any single frequency.

24 Claims, 3 Drawing Sheets

140

10

140

| | | | | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| ADDER | 1 | | | 2 | | | 3 | | | 4 | | | 5 | | | 6 | | | 7 | | | 8 | | | 9 | | | 10 | | | 11 | | | 12 | | | 13 | | | 14 | |
| FRAME SIZE | 16 | | | | | | | | | | | | | | | | | | | | | | | | | | | | | | | | | | | | | | | | | | | |
| SEED | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | 1 | 1 | 0 | 2 | 2 | 0 | 3 | 3 | 0 | 4 | 4 | 0 | 5 | 5 | 0 | 6 | 6 | 0 | 7 | 7 | 0 | 8 | 8 | 0 | 9 | 9 | 0 | 10 | 10 | 0 | 11 | 11 | x | 12 | 12 | 0 | 13 | 13 | 0 | 14 | 14 |
| | 2 | 2 | 0 | 4 | 4 | 0 | 6 | 6 | 0 | 8 | 8 | 0 | 10 | 10 | 0 | 12 | 12 | 0 | 14 | 14 | 0 | 16 | 0 | 1 | 18 | 2 | 1 | 20 | 4 | 1 | 22 | 6 | x | 24 | 8 | 1 | 26 | 10 | 1 | 28 | 12 |
| | 3 | 3 | 0 | 6 | 6 | 0 | 9 | 9 | 0 | 12 | 12 | 0 | 15 | 15 | 0 | 18 | 2 | 1 | 21 | 5 | 1 | 8 | 8 | 0 | 11 | 11 | 0 | 14 | 14 | 0 | 17 | 1 | x | 20 | 4 | 1 | 23 | 7 | 1 | 26 | 10 |
| | 4 | 4 | 0 | 8 | 8 | 0 | 12 | 12 | 0 | 16 | 0 | 1 | 20 | 4 | 1 | 8 | 8 | 0 | 12 | 12 | 0 | 16 | 0 | 1 | 20 | 4 | 1 | 24 | 8 | 1 | 12 | 2 | x | 16 | 0 | 1 | 20 | 4 | 1 | 24 | 8 |
| | 5 | 5 | 0 | 10 | 10 | 0 | 15 | 15 | 0 | 4 | 4 | 0 | 9 | 9 | 0 | 14 | 14 | 0 | 19 | 3 | 1 | 8 | 8 | 0 | 13 | 13 | 0 | 18 | 2 | 1 | 23 | 7 | x | 12 | 12 | 0 | 17 | 1 | 1 | 22 | 6 |
| | 6 | 6 | 0 | 12 | 12 | 0 | 18 | 2 | 1 | 8 | 8 | 0 | 14 | 14 | 0 | 20 | 4 | 1 | 10 | 10 | 0 | 16 | 0 | 1 | 22 | 6 | 1 | 12 | 12 | 0 | 18 | 2 | x | 24 | 8 | 1 | 14 | 14 | 0 | 20 | 4 |
| | 7 | 7 | 0 | 14 | 14 | 0 | 5 | 5 | 0 | 12 | 12 | 0 | 19 | 3 | 1 | 10 | 10 | 0 | 17 | 1 | 1 | 8 | 8 | 0 | 15 | 15 | 0 | 22 | 6 | 1 | 13 | 13 | x | 20 | 4 | 1 | 27 | 11 | 1 | 18 | 2 |
| | 8 | 8 | 0 | 16 | 0 | 1 | 8 | 8 | 0 | 16 | 0 | 1 | 8 | 8 | 0 | 16 | 0 | 1 | 8 | 8 | 0 | 16 | 0 | 1 | 24 | 8 | 1 | 16 | 0 | 1 | 24 | 8 | x | 16 | 0 | 1 | 24 | 8 | 1 | 16 | 0 |
| | 9 | 9 | 0 | 2 | 2 | 0 | 11 | 11 | 0 | 4 | 4 | 0 | 13 | 13 | 0 | 6 | 6 | 0 | 15 | 15 | 0 | 8 | 8 | 0 | 17 | 1 | 1 | 10 | 10 | 0 | 19 | 3 | x | 12 | 12 | 0 | 21 | 5 | 1 | 14 | 14 |
| | 10 | 10 | 0 | 4 | 4 | 0 | 14 | 14 | 0 | 8 | 8 | 0 | 18 | 2 | 1 | 12 | 12 | 0 | 22 | 6 | 1 | 16 | 0 | 1 | 10 | 10 | 0 | 20 | 4 | 1 | 14 | 14 | x | 24 | 8 | 1 | 18 | 2 | 1 | 28 | 12 |
| | 11 | 11 | 0 | 6 | 6 | 0 | 17 | 1 | 1 | 12 | 12 | 0 | 7 | 7 | 0 | 18 | 2 | 1 | 13 | 13 | 0 | 8 | 8 | 0 | 19 | 3 | 1 | 14 | 14 | 0 | 25 | 9 | x | 20 | 4 | 1 | 15 | 15 | 0 | 26 | 10 |
| | 12 | 12 | 0 | 8 | 8 | 0 | 4 | 4 | 0 | 16 | 0 | 1 | 12 | 12 | 0 | 8 | 8 | 0 | 20 | 4 | 1 | 16 | 0 | 1 | 12 | 12 | 0 | 24 | 8 | 1 | 20 | 4 | x | 16 | 0 | 1 | 28 | 12 | 1 | 24 | 8 |
| | 13 | 13 | 0 | 10 | 10 | 0 | 7 | 7 | 0 | 4 | 4 | 0 | 17 | 1 | 1 | 14 | 14 | 0 | 11 | 11 | 0 | 8 | 8 | 0 | 21 | 5 | 1 | 18 | 2 | 1 | 15 | 15 | x | 12 | 12 | 0 | 25 | 9 | 1 | 22 | 6 |
| | 14 | 14 | 0 | 12 | 12 | 0 | 10 | 10 | 0 | 8 | 8 | 0 | 6 | 6 | 0 | 20 | 4 | 1 | 18 | 2 | 1 | 16 | 0 | 1 | 14 | 14 | 0 | 12 | 12 | 0 | 26 | 10 | x | 24 | 8 | 1 | 22 | 6 | 1 | 20 | 4 |
| | 15 | 15 | 0 | 14 | 14 | 0 | 13 | 13 | 0 | 12 | 12 | 0 | 11 | 11 | 0 | 10 | 10 | 0 | 9 | 9 | 0 | 8 | 8 | 0 | 23 | 7 | 1 | 22 | 6 | 1 | 21 | 5 | x | 20 | 4 | 1 | 19 | 3 | 1 | 18 | 2 |
| | 16 | 0 | 1 | 16 | 0 | 1 | 16 | 0 | 1 | 16 | 0 | 1 | 16 | 0 | 1 | 16 | 0 | 1 | 16 | 0 | 1 | 16 | 0 | 1 | 16 | 0 | 1 | 16 | 0 | 1 | 16 | 0 | x | 16 | 0 | 1 | 16 | 0 | 1 | 16 | 0 |
| | | | 1 | | | 2 | | | 3 | | | 4 | | | 5 | | | 6 | | | 7 | | | 8 | | | 9 | | | 10 | | | 11 | | | 12 | | | 13 | |

Table 2

Fig. 3

METHOD AND SYSTEM FOR ENHANCED DIMMING RESOLUTION IN A LIGHT BALLAST THROUGH USE OF MULTIPLE CONTROL FREQUENCIES

FIELD OF THE INVENTION

The present invention relates generally to light ballasts and more particularly to a method and system for providing a high resolution dimmable light ballast.

BACKGROUND OF THE INVENTION

FIG. 1 is a block diagram of a dimmable light ballast system 10. The system 10 includes a microcontroller 12 which typically controls a dimmable light ballast 16 via its controller 11 and a timer structure 14. Electronic dimmable ballasts are controlled by on/off pulses. Varying the pulse lengths up and down controls the brightness of the light. A pulse is typically generated by dividing a frequency base through a series of fixed prescalers and/or programmable dividers. High resolution frequency control in dimmable light ballasts is conventionally addressed by using a low frequency digital part which is connected to analog components. This combination of elements converts low frequency pulses to a series of high frequency pulses. This method is referred to as indirect PWM control.

Light ballasts are utilized in a variety of applications. Oftentimes, these light ballasts are dimmable. However, it is important that the dimming resolution be of high resolution to allow for a variety of settings of light.

The resolution for a traditional timer frequency divider is:

$$f_{GEN} = \frac{f_{BASE}}{n} \tag{1}$$

The human eye is sensitive to variations of the light level, and frequency changes must be small for the eye not to notice. The frequency can be changed with a resolution expressed by equation 2 below.

$$\Delta f_{GEN} = \frac{f_{BASE}}{n-1} - \frac{f_{BASE}}{n} = \frac{f_{BASE}}{n*(n-1)} \tag{2}$$

For a high resolution light ballast, the target for frequency change is less than 50 Hz. At 80 kHz frequency and 50 Hz resolution the divider value becomes:

$$\Delta f_{GEN} \leq \frac{f_{GEN}*n}{n*(n-1)} \tag{3}$$

Solving equation (3) for a frequency of 80 kHz and a resolution of 50 Hz gives n=1600. Inserting n=1600 gives a frequency base of 80 Hz*1600=128 MHz which is a very high frequency.

Today designs are using lower frequency timer outputs, which are multiplied externally to higher frequencies, often using analog technology, i.e., an indirect method is used to control the pulse width. These designs therefore are controlled by some type of timer structure. There are a variety of known timer structures. Some of them are described in summary fashion below.

1. Advanced Timer Structures

Advanced timer structures have previously been used in microcontrollers to allow use of multiple frequencies. Some typical methods include:

a. Timer with Down-counter and Reload Registers

The counter counts down until it reaches zero. It then reloads from a reload register, toggles an output and interrupt a processor, which can load the reload register with a different value. For 50% duty cycle, a single register per pulse is needed. If pulse width modulation is needed, two reload registers per pulse are needed. Very few processors support interrupt rates at the frequencies used in ballasts. This type of timer is very common, both in low and high-end controllers.

b. Timer with Down-counter and Multiple Reload Registers

A variation of the counter above uses multiple reload registers. Typically an additional set is used. The use of this structure is mainly to allow a frequency to change as a result of an external event, and will only allow a single change, without processor intervention.

Again, this results in very high interrupt rates. An additional counter can be connected allowing the frequency to change only after a number of pulses has been generated.

c. Timer Complex with Chain Mode

To achieve the average frequency improvement to $1/16^{th}$ of that of a single frequency, 16 or 32 reload registers are needed. Such implementations are available in advanced processors. The timer complex may have a "chain" mode, where a timer controls an output on the microcontroller. It operates for a certain time, but when a specific event occurs, it will forward control of output to a different timer which is "chained" to the first timer. The Motorola TPU Timer Processing Unit is a typical example of such a timer. The TPU is implemented using a programmable controller and uses significant chip area.

d. Timer with Down-counter and Reload Registers and DMA Support

Some processors can maintain the reload registers in a table in an inexpensive SRAM. When the counter is loaded from the reload register, a DMA request is generated, and the DMA controller will load the reload register from the table. The DMA can support a circular buffer structure where the index of the table is automatically reset to the start of table when the end of table is reached. While this implementation is less expensive than the timer complex, it is still fairly expensive, and is not good for low cost implementation. This implementation is typically used for motor control.

e. Serial Interfaces

Serial communications peripherals with bit rates at the base frequency can be used to generate any bit sequence, and can obviously be used to emulate a timer. This relies on storing the bit pattern in an internal buffer and is much more expensive than the timer structure, making it unattractive for low cost implementation.

f. Timer with Up/Down-counter and Compare Registers

A timer structure similar to the down counter with reload is the counter with compare register. The timer counts up/down until a programmable value is reached. It then either reloads with a fixed value or from a small set of fixed values, or changes direction. Both structures are inherently relying on large blocks of external hardware in the form of processors, multiple reload registers or DMA support to change the frequency.

g. PWM Timer with Dithering Support

Some low-end microcontrollers implement Digital to Analog converters using a pulse width modulated timer. The output is filtered through an analog filter, and the output voltage is depending on the pulse width of the timer (ratio tHIGH/(tHIGH+tLOW). By varying the pulse width, the output voltage can be changed. The cost of the analog filter is depending on the PWM frequency and it is desirable to avoid lower frequencies. The problem is similar to that of the ballast, since dividing a base frequency with a programmable value generates the PWM frequency.

To increase the resolution of the D/A converter, some microcontrollers (including those focusing on CRT monitors) use dithering or flank width modulation. The PWM pulses are divided into frames of longer or shorter than the nominal value in a pulse width register. The "average" pulse length is thus increased or decreased by 1/nth of a clock pulse every time a flank is modulated. The PWM frequency is not changed to avoid problems with the analog filter.

h. Clock Generator with Added Noise

Some clock generators used to provide a system clock for an electronic system vary the frequency over a short frequency interval to divide the energy over a larger frequency spectrum. This function is mainly there to reduce EMI, and chips implementing this normally does not allow controlling the variation of the clock frequency in a predictable manner, and generally lack all other features necessary to implement ballast control.

Accordingly, all of the above implementations either require complex circuitry and typically require microcontrol. The present invention addresses such a need.

SUMMARY OF THE INVENTION

A microcontroller or state machine controls a light ballast utilizing a timer structure. The microcontroller can program the timer structure to generate pulses where the "average" frequency of a series of pulses can be varied with higher resolution than the frequency of a single pulse. This variation can occur without further microcontroller/state machine intervention. The pulses are used to control the on and/or off time of the light. The timer can be configured to modulate the outputs fast enough to ensure that the light does not appear to flicker to the human eye by limiting the number of pulses in a frame and by increasing the number of times the frequency shift occurs compared to the obvious implementation.

The present invention relies on the fact that the human eye is not capable of detecting small frequency changes in high frequency signals and therefore uses pulses of two or more frequencies where the frequencies are close together. The average frequency can then be varied at much higher resolution than any single frequency.

BRIEF DESCRIPTION OF THE DRAWINGS

FIG. 3 is a Table 2 which illustrates the operation of another timer structure which includes an adder which increases or decreases by a programmable value for each increase or decrease in the light intensity of the light ballast.

DETAILED DESCRIPTION

The present invention relates generally to light ballasts and more particularly to a method and system for providing a high resolution dimmable light ballast. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Electronic dimmable ballasts are controlled by on/off pulses. Varying the pulse lengths up and down controls the brightness of the light. A pulse is typically generated by dividing a frequency base through a series of fixed prescalers and/or programmable dividers.

A designer of a ballast typically chooses to use a variable frequency with a fixed ratio of on time and off time (frequency control), or of a mixed frequency where the ratio of on time to off-time can be varied (PWM control). A fixture of the two where the frequency and the ratio can be varied is conceivable. A system and method in accordance with the present invention is applicable in all three variations, but will be explained using the frequency paradigm where the pulse length is varied by changing the frequency.

The objective of the present invention is:

1. To reduce the base frequency required achieving a certain resolution at a certain target frequency to a frequency lower than that required by a normal frequency divider.

2. To use direct PWM/frequency control allowing integration of the functionality into an inexpensive microcontroller using a standard semiconductor process.

3. To reduce the processing requirement to allow implementation using low cost 8 bit controllers. The invention relies on the fact that the human eye is not capable of detecting small frequency changes in high frequency signals and uses pulses of two or more frequencies. The average frequency can be varied at much higher resolution than any single frequency.

A system and method in accordance with the present invention comprises a timer capable of generating a sequence of on-time and off-time pulses where the on and/or off-time pulse lengths can be programmed to continuously switch between at least two different values at a particular resolution within a time period short enough to avoid flickering in a dimmable ballast light system. To describe the features of the present invention in more detail refer now to the following discussion in conjunction with the accompanying figures.

Figure 1:
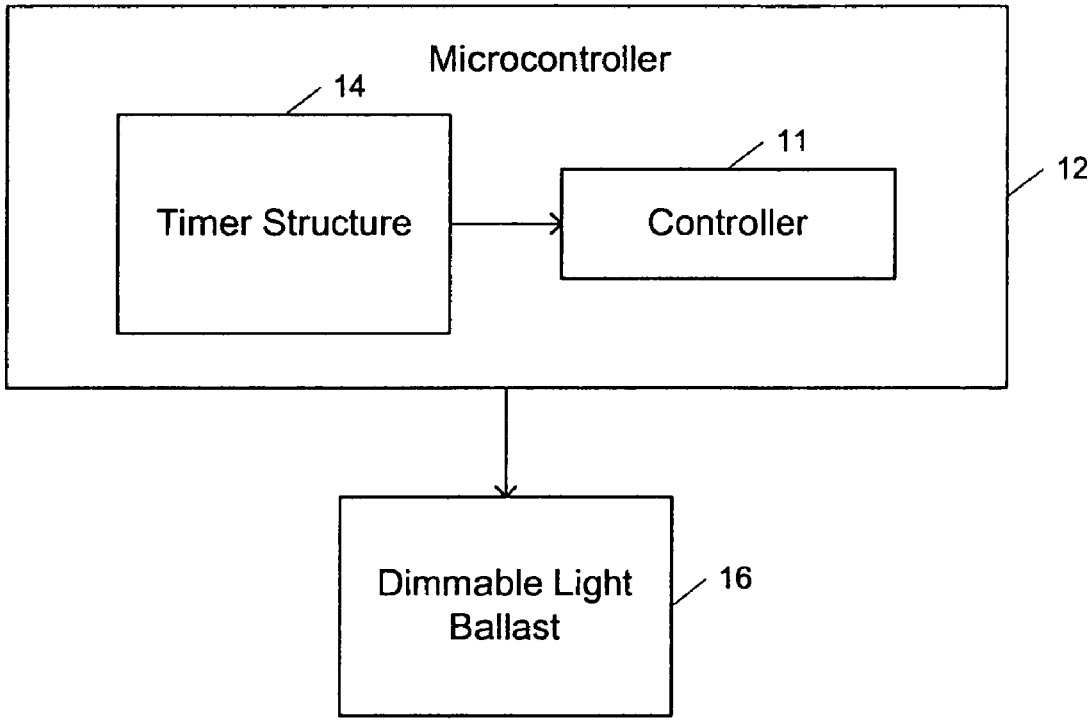
Figure 1 (PRIOR ART)
FIG. 1 is a block diagram of a dimmable light ballast system.
Figure 2:
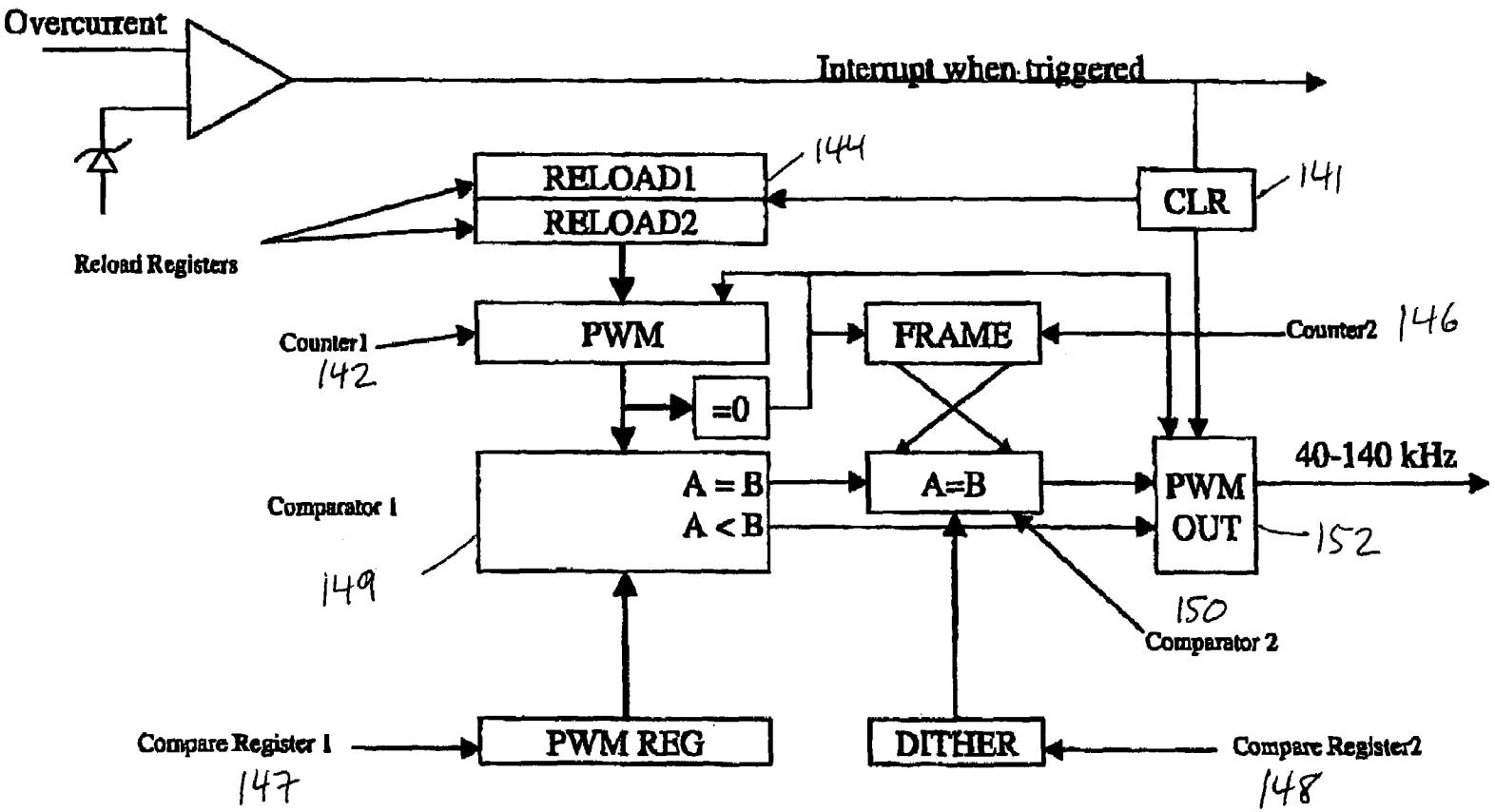
FIG. 2 is a block diagram of a timer for providing controlling a light emitting device in accordance with the present invention.

FIG. 2 is a block diagram of a timer structure 140 in accordance with the present invention. The timer structure receives a clock signal that is fed into a first counter (PWM) 142. In this embodiment, two reload registers 144 are utilized but a single register or more could be utilized and this would be within the spirit and scope of the present invention. Each of the reload registers 144 may include a different pulse length value. In a preferred embodiment a security mechanism 153 is utilized to deassert on-time signals when error conditions are detected. During operation, the first counter 142 counts down until zero is reached and then it restarts by reloading from one of the reload registers.

When the value in counter 142 is less than a predetermined value in a compare register 147 indicating that the resolution can not be changed the output from the comparator is provided directly to the output decision logic (PW- MOUT) 152 of the pulse width modulator, which sets/clears the PWM signal and its inverse respecting requirements for non-stop.

Whenever the first counter 142 has reached a predetermined value indicating one cycle is completed (i.e., the counter 142 has reached zero), a second counter 146 (frame) is incremented. When the contents of the counter 142 are equal to the contents of the register 147 the contents of a "dither" register 148 via comparator 150 to determine the ratio of first counter 142 pulses that should be extended by one clock cycle for a particular resolution. For example if a frame is 4 bits wide, between 0 to 15 pulses can be extended in a 16 pulse frame.

If the comparison was performed normally only the first pulses would be extended (I.e., if 3 out of 16 pulses should be extended, pulses 0 . . . 2 would be extended and pulses 3.15 would not be extended). However, to spread the pulses out, the counter 146 value is bit reversed before the comparison. An example of a normal comparison versus a bit reversed comparison is shown in Table 1.

TABLE 1

| pulse | normal | <=2 | | bitreversed | <=2 |
|---|---|---|---|---|---|
| 0 | 0000 | 1 | -> | 0000 | 1 |
| 1 | 0001 | 1 | -> | 1000 | 0 |
| 2 | 0010 | 1 | -> | 0100 | 0 |
| 3 | 0011 | 0 | -> | 1100 | 0 |
| 4 | 0100 | 0 | -> | 0010 | 1 |
| 5 | 0101 | 0 | -> | 1010 | 0 |
| 6 | 0110 | 0 | -> | 0110 | 0 |
| 7 | 0111 | 0 | -> | 1110 | 0 |
| 8 | 1000 | 0 | -> | 0001 | 1 |
| 9 | 1001 | 0 | -> | 1001 | 0 |
| 10 | 1010 | 0 | -> | 0101 | 0 |
| 11 | 1011 | 0 | -> | 1101 | 0 |
| 12 | 1100 | 0 | -> | 0011 | 0 |
| 13 | 1101 | 0 | -> | 1011 | 0 |
| 14 | 1110 | 0 | -> | 0111 | 0 |
| 15 | 1111 | 0 | -> | 1111 | 0 |

As is seen with the normal comparison, the first three pulses get a "match". With the bit reversed comparison, the pulses 0,4 and 8 get a match.

An optimal distribution is reached by using differential data synthesis (DDS), where utilizing a frame size of 16, 16/n would be added to the number. Accordingly, where n=3 16/3 would be added to the number. The algorithm for implementing DDS would require more logic and be relatively expensive utilizing present day technology. However, one of ordinary skill in the art recognizes that there may be a time that this type of algorithm may require significantly less die area and could be readily utilized in such an application.

FIG. 3 is a Table 2 which illustrates the operation of the timer structure which includes an adder which increases or decreases by n for each increase or decrease in the light intensity of the light ballast. The system would operate in accordance with the following algorithm.

```
x=0
adder=n
loop
    x=x+adder;                  //Result in Column 1, Table 2
0 if (x >- framesize) then;
        x=x = framesize         //Result in Column 2 Table T
        extend=1;               //Result in Column 2, Table 2
    else
        extend=0;
    end if
end loop;
```

As is seen in Column 3, as the frequency increases, the number of pulses that should extended by one cycle increases in a distributed fashion.

Embodiments

In a preferred implementation, the control mechanism allows the average pulse width over a sequence of pulses to be programmed without specifying a value for each and every pulse.

In a preferred implementation, only two frequencies are used, the dividers only differ by one. f1=f/n, f2=f(n−1), allowing the control mechanism to choose between extending a pulse by one clock or not, instead or providing two unrelated values.

In a preferred implementation, the number of cycles in a frame is fixed, and the number of cycles to be extended is programmable.

In a less desirable implementation, the number of extended cycles is fixed, and the number of cycles in a frame is programmable.

In a less desirable implementation, the number of extended cycles and the number of cycles per frame are both programmable.

In a preferred implementation, the number of pulses to be extended in each frame is supplied as a number to the timer.

In a preferred implementation, the pulse-width is in the upper parts of a register, while the number of pulses to be extended is in the lower part of the register. This treats the average value as a fractional number.

In a less desirable implementation, the number of pulses to be extended is in the upper part of a register and the pulse-width is in the lower part of the register. This simplifies the silicon implementation allowing a timer with a long time period to be used in several modes without adding too much logic.

In a less desirable implementation, the pulse width and the information regarding which pulses are to be extended is separated into two or more registers.

It is to be noted, that when a register is wider than the data-width of the micro-controller it can take several memory cycles to access a register.

In a less desirable implementation, there is a register or set of registers containing one or more bits for each pulse or for a group of pulses in the frame, which is used to determine whether a pulse should have a certain pulse length or another pulse length.

Distribution of Pulses

In a preferred implementation, the timer maintains a frame-counter, which is updated with every pulse or group of pulses. It has a dual purpose, the first purpose is to introduce a mechanism to detect the end of a frame and start a new one, and the second purpose is to allow a mechanism to decide whether to extend a pulse or not.

In a preferred implementation, the frame-counter counts up or down in a linear fashion.

In a less desirable implementation, the frame-counter counts in a non-linear fashion. An example is a "Gray" counter.

In a less desirable implementation, the frame-counter directly is compared to the number of pulses to be extended, and if the frame-counter is lower or equal to the number of pulses, the current pulse is extended.

In a preferred implementation, the frame-counter and/or the number of pulses are scrambled through bit reversal to binary distribute the number of pulses.

In a less desirable implementation, DDS (Digital Differential Synthesis) algorithms are used to distribute the pulses. It will distribute the pulses more evenly, but will cost more logic.

In a less desirable implementation, the pulses are distributed using a random fashion using a pseudo-random generator.

Counter

The pulse-length functionality can be implemented using a down counter, an up counter or an up-down counter.

The down-counter approach compares the counter with an end value, which is normally zero. When the end value is reached, the counter is reloaded from one of a set of reload registers.

The up-counter approach compares the counter with a set of compare registers. When a compare match is detected, the timer can toggle an I/O pin, or start a new cycle and maybe generate an interrupt.

The up-down counter approach counts up until a compare-match occurs, which may or may not be programmable. It then counts down until zero, before it restarts counting up. A compare register will determine if the counter is below, equal or above the compare register and a match can force the setting or resetting of a pin.

Compare registers can be attached to the counters, to force events in the middle of a counter cycle.

In a preferred implementation, the down-counter approach is used.

Extending a Pulse

In a preferred implementation, a pulse can be extended by stopping the counter temporarily or by manipulating a reload or a compare register value.

The reload/compare values can contain the on time, the off time or a combination of both. The timer is normally connected to two outputs allowing direct control of the output pulses. The reload/compare values can contain times for either one or both outputs. Either of the on/off-time cycles or both can be modulated.

In a less desirable implementation, the timer block provides a single output which can be used by an external circuit to drive a half-bridge or full-bridge.

Dead Time

In a preferred implementation there are two outputs with programmable "dead-time" between the on time of one output and the on time of the other output.

In a preferred implementation, there are two outputs with inverted outputs, allowing direct drive of an inverting transistor between the part containing the invention and the power transistor (typically a FET transistor).

In a preferred implementation, the micro-controller contains a fuse setting which sets the initial state of the output pin to a value, which disables any power transistors in the system.

In a preferred implementation, external hardware (i.e., pullup/pulldown resistors) set the initial state of the outputs.

Number of Reload/Compare Registers

In a preferred implementation, the registers have shadow registers, which can be selected instead of the "normal" registers to handle error conditions. Both normal and shadow registers can support pulse extension.

In a preferred implementation, there are security mechanisms that can deassert the on-time signals when error conditions are detected. (FIG. 2, 153.)

In a preferred implementation, the error circuitry may either interrupt the microcontroller, which can subsequently reprogram the timer block, and/or it may directly change the timer frequency before a possible interrupt using values in shadow registers.

Advantages

1. A system and method in accordance with the present invention uses direct control of a pulse width (PWM), making it more cost effective/using less board space than previous indirect control solutions using analog PWM circuits for the high frequency.

2. A system and method in accordance with invention implements a frequency generator using a relatively small base frequency, which can be implemented in low cost controllers. Low frequency reduces the power consumption compared to a pure frequency divider, and is advantageous for other reasons including EMI considerations.

3. A system and method in accordance with the present invention combines low base frequency with high resolution, making it more attractive for dimmable ballasts.

4. A system and method in accordance with the present invention can be implemented in a very small die area compared to timer complexes, DMA driven timers or timers with multiple reload registers, making it possible to reduce the cost of a microcontroller for ballasts.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims. An example of such a modification is a mechanism to guarantee "dead time" between two different outputs which ensures that both FET transistors, in a half bridge and not turned on at the same time.

What is claimed is:

1. A timer structure comprising:

at least one reload register, the at least one reload register including different values; and a counter mechanism coupled to the at least one reload register, wherein the counter mechanism generates pulses based upon the values in the at least one reload register in a manner that a high resolution dimming output is provided without processor or state machine intervention, wherein the counter mechanism comprises:

a first counter for receiving the values from the at least one reload register;

a second counter, the contents of the second counter being incremented after the first counter has reached a first predetermined value; and a comparator mechanism for causing a predetermined number of pulses to be extended based upon a comparison of the contents of the second counter with a second predetermined value.

2. The timer structure of claim 1 wherein the first predetermined value is zero.

3. The timer structure of claim 1 wherein the at least one reload register contains a pulse length value.

4. The timer structure of claim 1 wherein the comparator mechanism comprises:

a register containing a second predetermined value; and a comparator for comparing the second predetermined value to the contents of the second counter to determine the ratio of pulses that are to be extended.

5. The timer structure of claim 4 wherein a pulse can be extended by changing a value within the register, typically the lower bit, either at the beginning or the end of a pulse.

6. The timer structure of claim 1 wherein a pulse can be extended by stopping the timer structure temporarily.

7. A light ballast system comprising:

a dimmable light ballast;

a microcontroller for controlling the dimmable light ballast, the microcontroller including a timer structure; the timer structure further comprising at least one of reload register, the at least one reload register including different values; and a counter mechanism coupled to the at least one reload register, wherein the counter mechanism generates pulses based upon the values in the at least one reload register in a manner that a high resolution dimming output is provided without processor or state machine intervention to change reload/compare values, wherein the counter mechanism further comprises:

a first counter for receiving the values from at least one reload register;

a second counter, the contents of the second counter being incremented after the first counter has reached a first predetermined value; and a comparator mechanism for causing a predetermined number of pulses to be extended based upon a comparison of the contents of the second counter with a second predetermined value.

8. The system of claim 7 wherein the first predetermined value is zero.

9. The system of claim 7 wherein the at least one reload register contains a pulse length value used to determine the frequency together with the counter and the comparator mechanism.

10. The system of claim 7 wherein the comparator mechanism comprises:

a register containing a second predetermined value; and a comparator for comparing the second predetermined value to the contents of the second counter to determine the ratio of pulses that are to be extended.

11. The system of claim 10 wherein a pulse can be extended by changing a value within the register.

12. The system of claim 7 wherein a pulse can be extended by stopping the timer structure temporarily.

13. A microcontroller comprising:

a controller; and a timer structure coupled to the controller; the timer structure further comprising at least one reload register, the at least one reload register including different values; and a counter mechanism coupled to the at least one reload register, wherein the counter mechanism generates pulses based upon the values in the at least one reload register in a manner that a high resolution dimming output is provided without processor or state machine intervention to change reload/compare values, wherein the counter mechanism further comprises:

a first counter for receiving the values from the at least one reload register:

a second counter, the contents of the second counter being incremented after the first counter has reached a first predetermined value; and a comparator mechanism for causing a predetermined number of pulses to be extended based upon a comparison of the contents of the second counter with a second predetermined value after the one cycle.

14. The microcontroller of claim 13 wherein the first predetermined value is zero.

15. The microcontroller of claim 13 wherein the at least one reload register contains a pulse length value used to determine the frequency.

16. The microcontroller of claim 13 wherein the comparator mechanism comprises:

a register containing a second predetermined value; and a comparator for comparing the second predetermined value to the contents of the second counter to determine the ratio of pulses that are to be extended.

17. The microcontroller of claim 16 wherein a pulse can be extended by changing a value within the compare register.

18. The microcontroller of claim 13 wherein a pulse can be extended by stopping the counter temporarily.

19. A timer structure comprising:

at least one reload register, the at least one reload register including different values; and a counter mechanism coupled to the at least one reload register, wherein the counter mechanism generates pulses based upon the values in the at least one reload register in a manner that an output is provided without processor or state machine intervention, wherein the counter mechanism comprises:

a first counter for receiving the values from the at least one reload register;

a second counter, the contents of the second counter being incremented after the first counter has reached a first predetermined value; and a comparator mechanism for causing a predetermined number of pulses to be extended based upon a comparison of the contents of the second counter with a second predetermined value.

20. The timer structure of claim 19 wherein the comparator mechanism comprises:

a first register containing a first predetermined value;

a first comparator for comparing the first predetermined value, the value from the first counter and for providing the output when the value in the first register is greater than the value from the first counter;

a second register containing a second predetermined value; and a second comparator for comparing the second predetermined value to the contents of the second counter to determine the ratio of pulses that are to be extended when the value in the first register is equal to the value from the first comparator.

21. A light ballast system comprising:

a dimmable light ballast;

a microcontroller for controlling the dimmable light ballast, the microcontroller including a timer structure; the timer structure further comprising at least one of reload register, the at least one reload register including different values, wherein the at least one plurality of reload registers comprise two reload registers, wherein the values of the two reload registers are sufficiently close to allow for the extending of a pulse by one clock cycle; and a counter mechanism coupled to the two reload registers, wherein the counter mechanism comprises a first counter for receiving the values from any of the two reload registers; a second counter, the contents of the second counter being incremented after the first counter has reached a first predetermined value; and a comparator mechanism for causing a predetermined number of pulses to be extended based upon a comparison of the contents of the second counter with a second predetermined value, wherein the counter mechanism generates pulses based upon the value in the at least one reload register in a manner that a high resolution dimming output is provided without processor or state machine intervention to change reload/compare values.

22. The system of claim 21 wherein the comparator mechanism comprises:

a first register containing a first predetermined value;

a first comparator for comparing the first predetermined value with the value from the first counter and for providing an output when the value in the first register is greater than the value from the first counter;

a second register containing a second predetermined value; and a second comparator for comparing the second predetermined value to the contents of the second counter to determine the ratio of pulses that are to be extended when the value in the first register is equal to the value from the first comparator.

23. A light ballast system comprising:

a dimmable light ballast;

a microcontroller for controlling the dimmable light ballast, the microcontroller including a timer structure; the timer structure further comprising at least one of reload register, the at least one reload register including different values; and a counter mechanism coupled to the at least one reload register, wherein the counter mechanism generates pulses based upon the values in the at least one reload register in a manner that an output is provided without processor or state machine intervention to change reload/compare values, wherein the counter mechanism further comprises:

a first counter for receiving the values from at least one reload register;

a second counter, the contents of the second counter being incremented after the first counter has reached a first predetermined value; and a comparator mechanism for causing a predetermined number of pulses to be extended based upon a comparison of the contents of the second counter with a second predetermined value.

24. The microcontroller of claim 23 wherein the comparator mechanism comprises:

a first register containing a first predetermined value;

a first comparator for comparing the first predetermined value the value from the first counter and for providing an output when the value in the first register is greater than the value from the first counter;

a second register containing a second predetermined value; and a second comparator for comparing the second predetermined value to the contents of the second counter to determine the ratio of pulses that are to be extended when the value in the first register is equal to the value from the first comparator.

* * * * *